US007051837B1

(12) United States Patent
Brahier

(10) Patent No.: US 7,051,837 B1
(45) Date of Patent: May 30, 2006

(54) FOLDING WORKBENCH AND DOLLY COMBINATION

(76) Inventor: Ken Brahier, 209 Barry Ct., Longwood, FL (US) 32779

( * ) Notice: Subject to any disclaimer, the term of this patent is extended or adjusted under 35 U.S.C. 154(b) by 32 days.

(21) Appl. No.: 10/770,003

(22) Filed: Feb. 2, 2004

Related U.S. Application Data

(60) Provisional application No. 60/444,142, filed on Jan. 31, 2003.

(51) Int. Cl.
*E06C 1/397* (2006.01)

(52) U.S. Cl. ..... 182/21; 182/129; 280/30

(58) Field of Classification Search ..... 182/20, 182/21, 129; 280/30, 47.18
See application file for complete search history.

(56) References Cited

U.S. PATENT DOCUMENTS 2,519,113 A * 8/1950 Israel ..... 280/659
3,954,155 A * 5/1976 Guidara ..... 182/20
3,999,628 A * 12/1976 Parson ..... 182/46
5,120,013 A * 6/1992 Sweeney ..... 248/238
5,419,409 A * 5/1995 Corulla ..... 182/129
5,622,463 A * 4/1997 Testa ..... 409/131
6,116,163 A * 9/2000 Mitchell ..... 108/42
6,173,811 B1 * 1/2001 Tornabene et al. ..... 182/20
6,240,987 B1 * 6/2001 Birkeland ..... 144/286.1
6,298,946 B1 * 10/2001 Yemini et al. ..... 182/153
6,328,330 B1 * 12/2001 Haaser ..... 280/645
6,502,664 B1 * 1/2003 Peaker, Sr. ..... 182/129
6,616,174 B1 * 9/2003 Bierma ..... 280/655

FOREIGN PATENT DOCUMENTS

CH 659615 A5 * 2/1987

* cited by examiner

*Primary Examiner*—Alvin Chin-Shue
(74) *Attorney, Agent, or Firm*—Allen, Dyer, Doppelt, Milbrath & Gilchrist, P.A.

(57) ABSTRACT

A folding workbench comprises a support frame, a pair of equipment support members, a work platform, a vise, a storage drawer, a light source, at least one electrical outlet, an electrical cord in a storage reel, a plurality of wheels, and at least one handle.

33 Claims, 8 Drawing Sheets

FOLDING WORKBENCH AND DOLLY COMBINATION

RELATED APPLICATION

This application claims priority from co-pending provisional application Ser. No. 60/444,142, which was filed on Jan. 31, 2003, and which is incorporated herein by reference in its entirety.

FIELD OF THE INVENTION

The present invention relates to the field of workbenches, and more specifically to a folding, compact workbench and dolly combination for a handyman.

BACKGROUND OF THE INVENTION

Skilled tradesmen are well aware of the difficulties involved in working at job sites remote to their own workshops. The tradesman must pack and transport all tools and accessories required for the work, and then set up at the job site. The present invention provides a compact, folding workbench and dolly combination which incorporates all necessary elements available in a standard workshop, and also allows the workman to transport tools, materials, and other necessary items to the work site. The present device may be adapted for use by the various trades, such as carpenters, plumbers, painters, electricians, etc.

SUMMARY OF THE INVENTION

With the foregoing in mind, the present invention advantageously provides a folding workbench which doubles as a load transport dolly allowing the workman to conveniently move tools and materials to a work site.

The folding workbench is a multi-use space saving shop tool. It combines many common shop tools and features into one handy device. The invention combines a 5 ft folding step ladder, upright equipment dolly with folding casters, lay down equipment dolly with swivel casters, folding workbench with shop vise, a multi-compartment tool drawer, a retractable multi-position shop light, a retractable power cord in a reel with a multiple outlet power strip, and a multi-purpose folding job shelf.

The folding workbench may be manufactured using a step ladder frame which appears typical but is actually different in the angle of the support legs when opened. This angle is wider than in a standard step ladder due to the need for increased stability of the folding workbench device. Construction of the device may be of materials such as, wood, aluminum, fiberglass, steel, plastic or any combination of these common materials, as known in the art.

The front portion of the folding workbench, also referred to as the ladder portion, has a typical folding stepladder appearance. A desirable arrangement for the stepladder would include 4" wide steps spaced 11" from the top of each step. The top of the ladder preferably includes two hinged opposing 2.50" wide support members, but may also be constructed having a single topmost member, as most typical step ladders.

The rear portion of the folding workbench includes two 2.50" wide brace members preferably spaced evenly 18" apart from top to bottom. The two rear legs are braced for stability using these two 2.50" wide, 18" long braces set perpendicular to and connecting the legs, with one brace member positioned approximately 11" from the lower end of the workbench, and the other brace member approximately 11" from the upper end of the workbench. The brace members are fitted with two equipment support members which preferably are 0.875"OD heavy gauge tubing each about 54" in length running parallel with each leg and inset 1" from the inside of each leg.

These two equipment support members will serve as the attachment and axis points for each of the following devices. The dolly casters attach toward the lower end of the equipment support members or support frame, and fold in for storage, fold out and lock in place for transport and equipment dolly use. The dolly tongue attaches to the lower end of the equipment support members in the 1" separating the support member from the leg and and folds in for storage, and folds out and locks in place for equipment dolly use. The work platform, and vise with accessory drawer attach to each of the equipment support members, preferably at about 30" from the lower end of the workbench, a distance which is adjustable, folds down between the support members for storage and transport, and folds out and locks in place for use. An optional multi-use job shelf attaches to each of the equipment support members just below the upper frame member, folds down for storage or folds out and locks in place for use. The retractable, multi-position shop light attaches to one of the equipment support members, folds out for use, and folds in between the support members, locking for storage. A retractable power cord reel attaches preferably adjacent a lower end of the frame and an electrical outlet strip mounts to the outside of one of the legs of the frame. A handle and swivel dolly casters attach adjacent upper ends of the equipment support members. The handle can be removed and reversed allowing the use of the swivel casters for lay down dolly use.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

Figure 1:
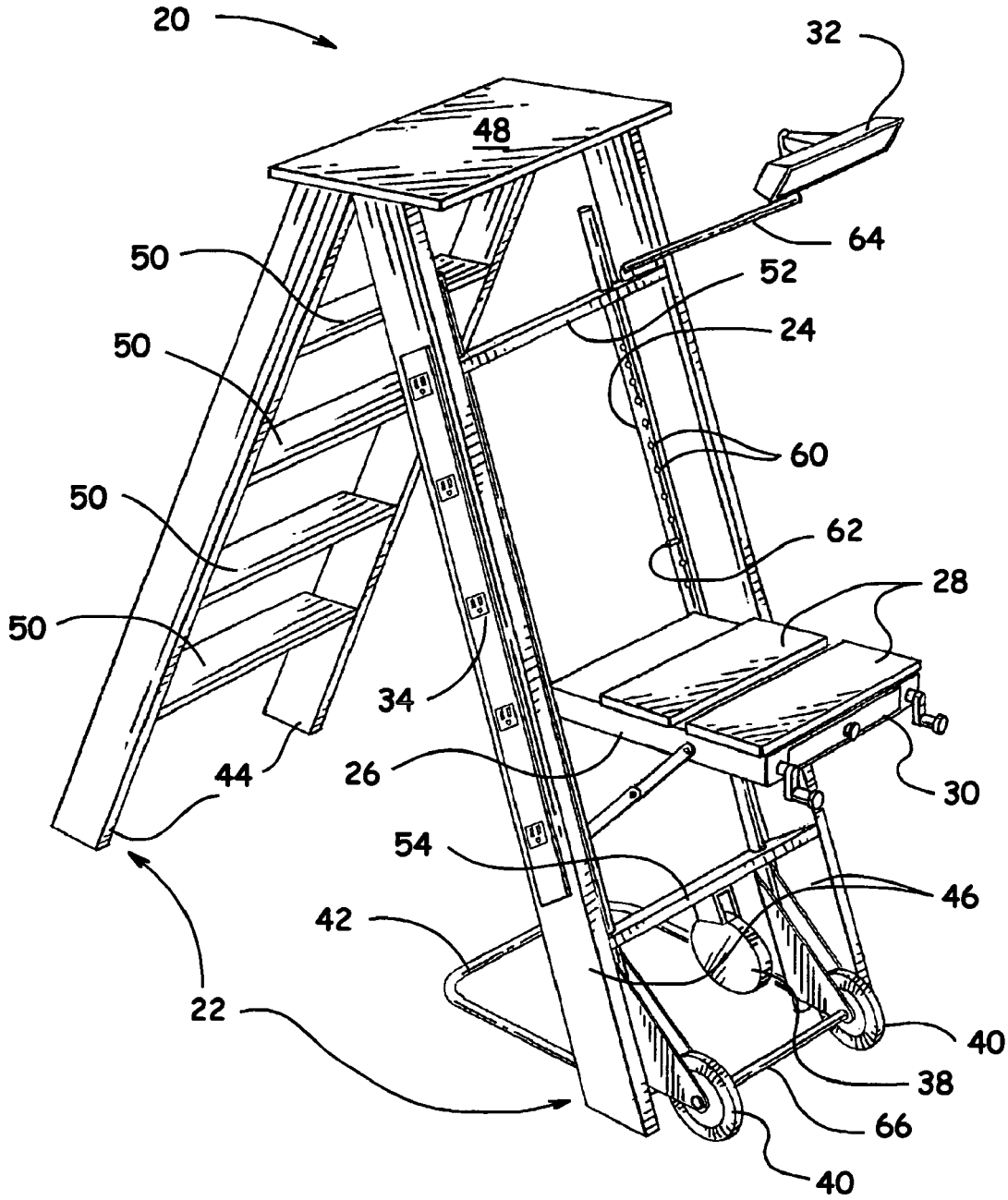
FIG. 1 is a perspective view of the folding workbench according to an embodiment of the present invention.
Figure 2:
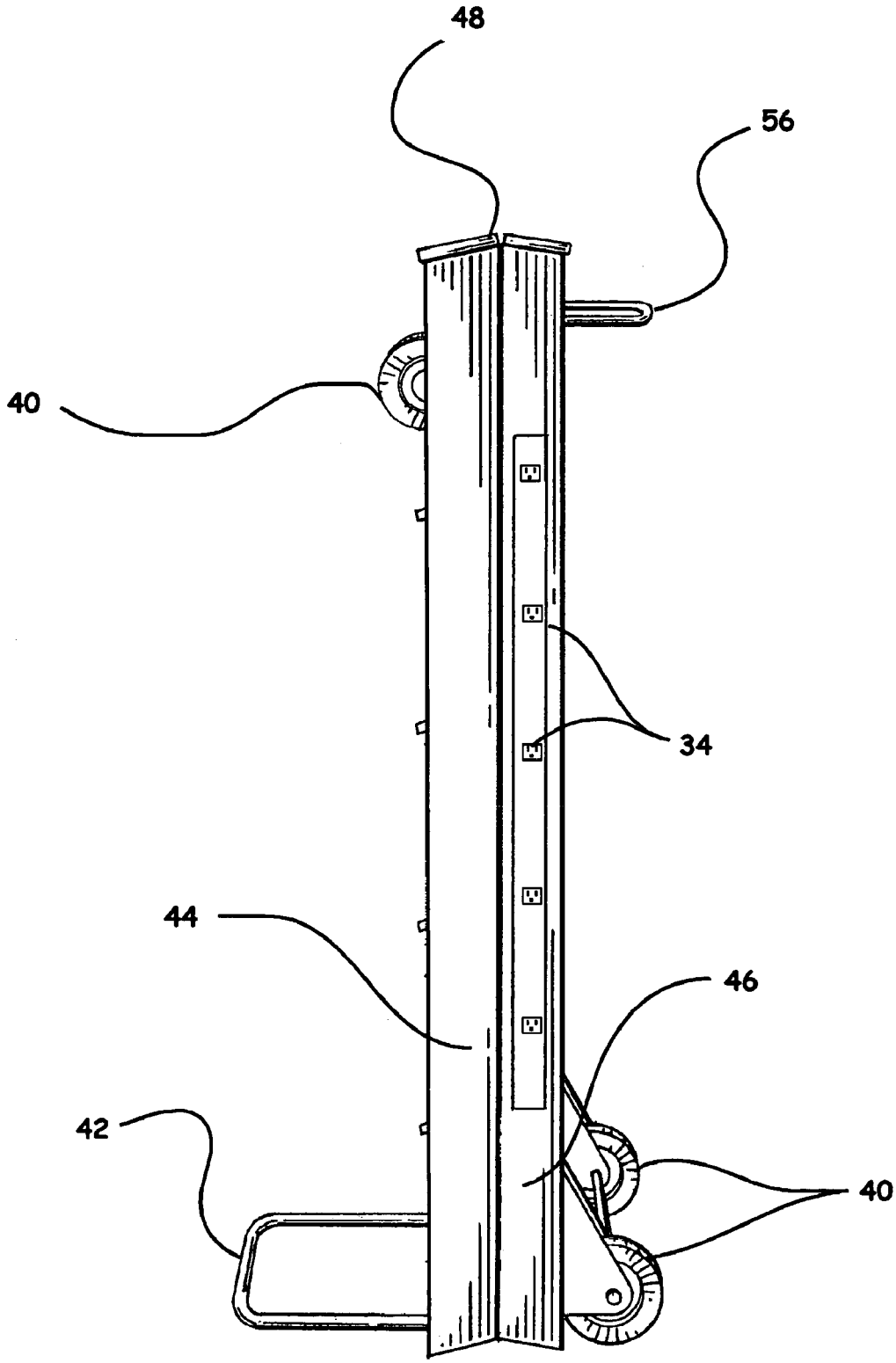
FIG. 2 shows a side elevation of the present folding workbench in a closed configuration ready to be used as a hand truck.
Figure 4:
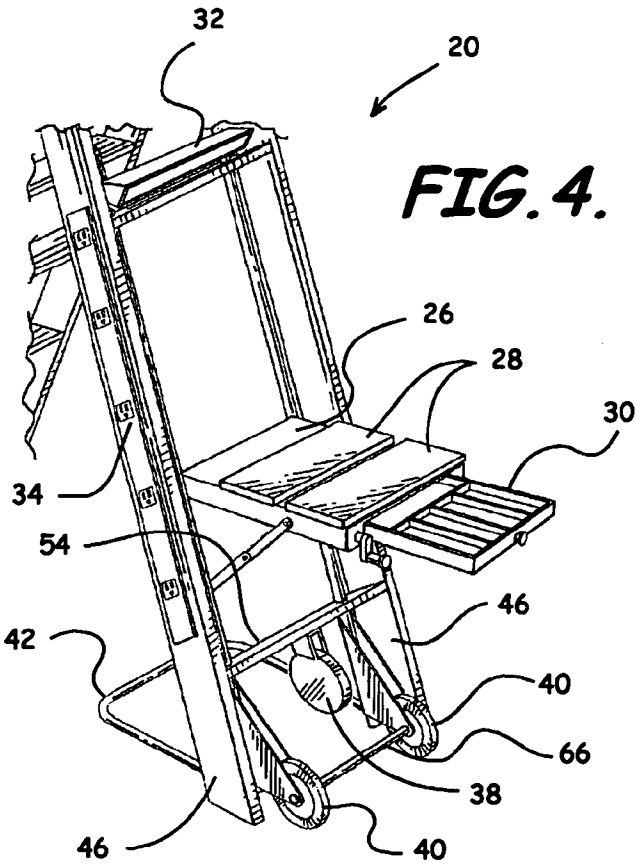
FIG. 4 is a closeup perspective view of the work platform, vise and storage drawer of the workbench of FIG. 1.
Figure 3:
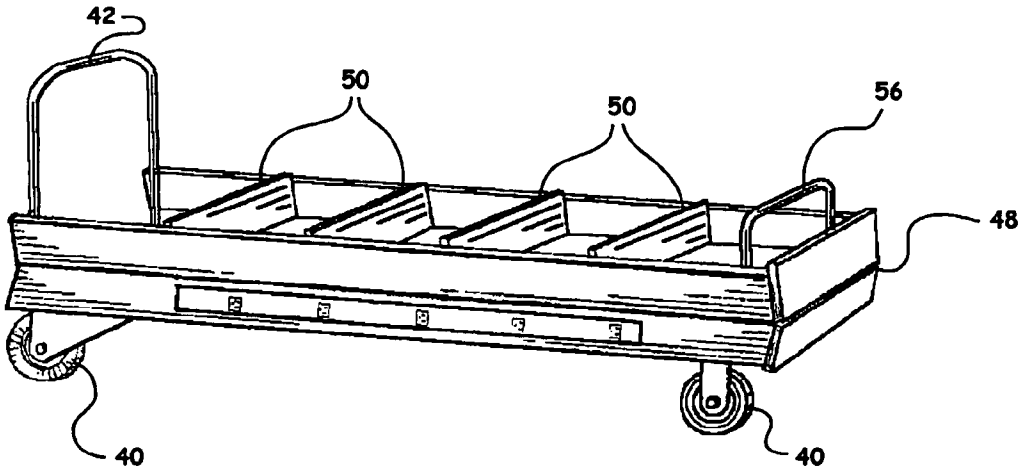
FIG. 3 shows a perspective side view of the folding workbench of FIG. 1 in a closed configuration and ready for use as a dolly.
Figure 5:
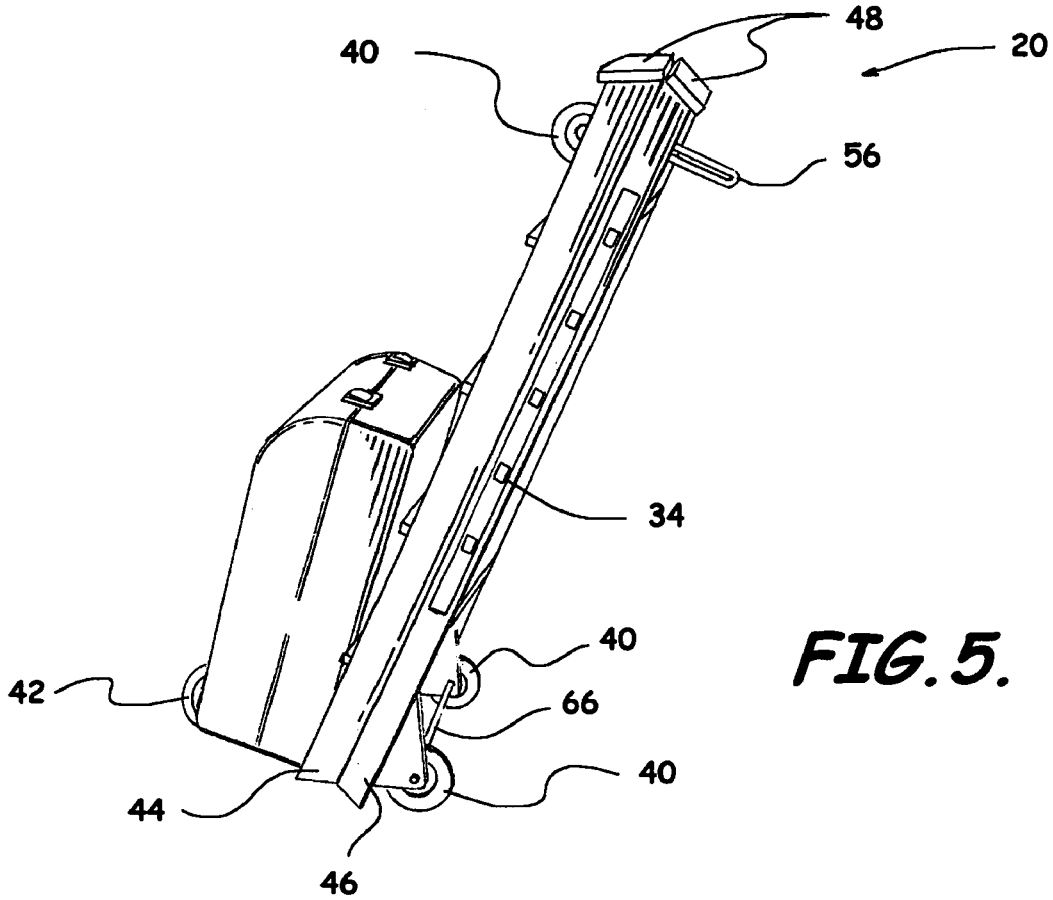
FIG. 5 is a side elevation view the folding workbench of FIG. 1 in use as a hand truck.
Figure 6:
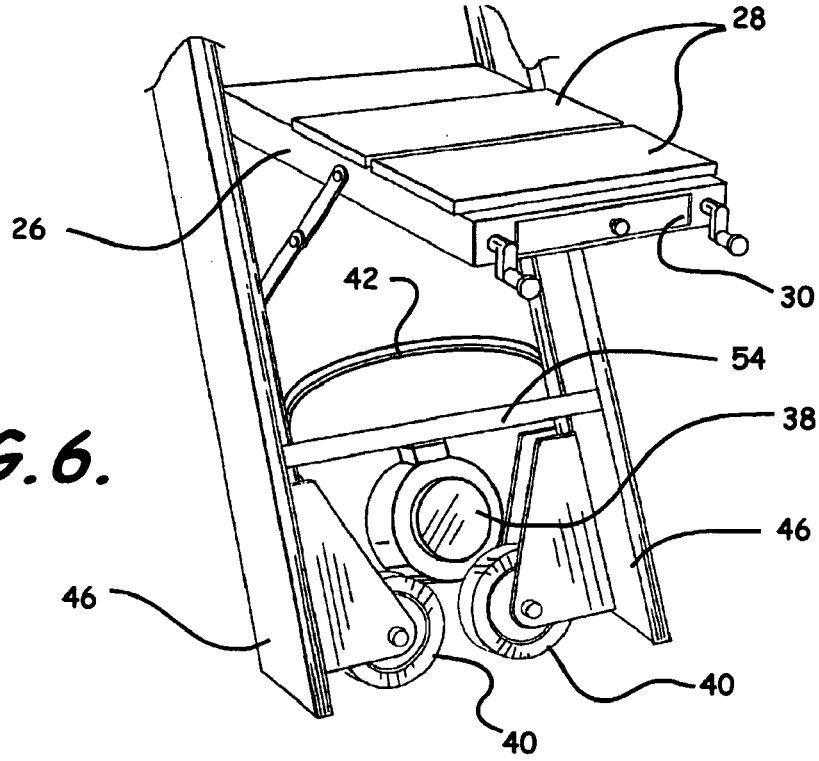
FIG. 6 is a perspective view showing closeup detail of the folding wheels or casters and a deployed work platform, vise and storage drawer.
Figure 7:
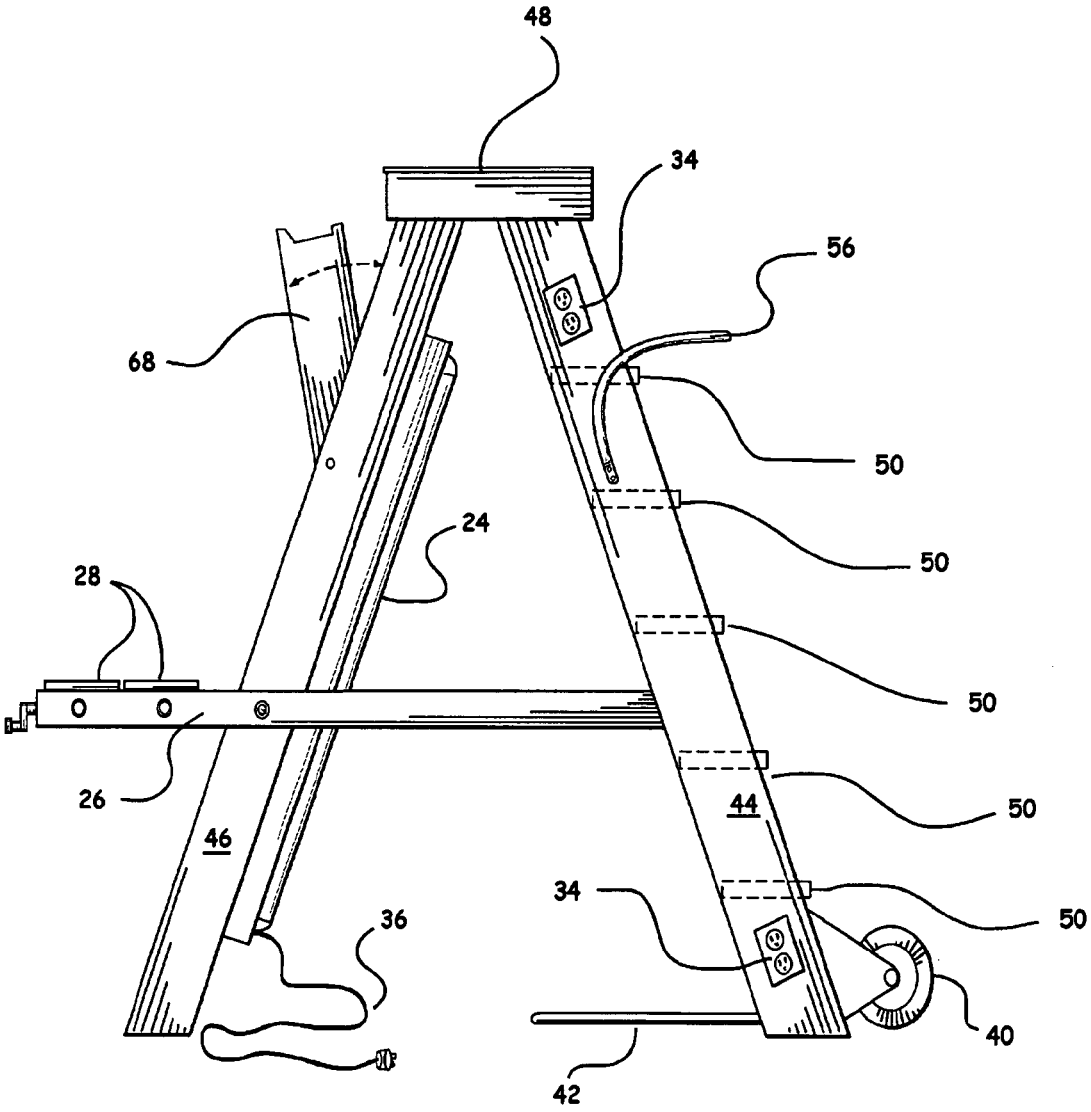
FIG. 7 is a side elevation view of the present invention deployed for use as a step ladder and workbench combination.
Figure 8:
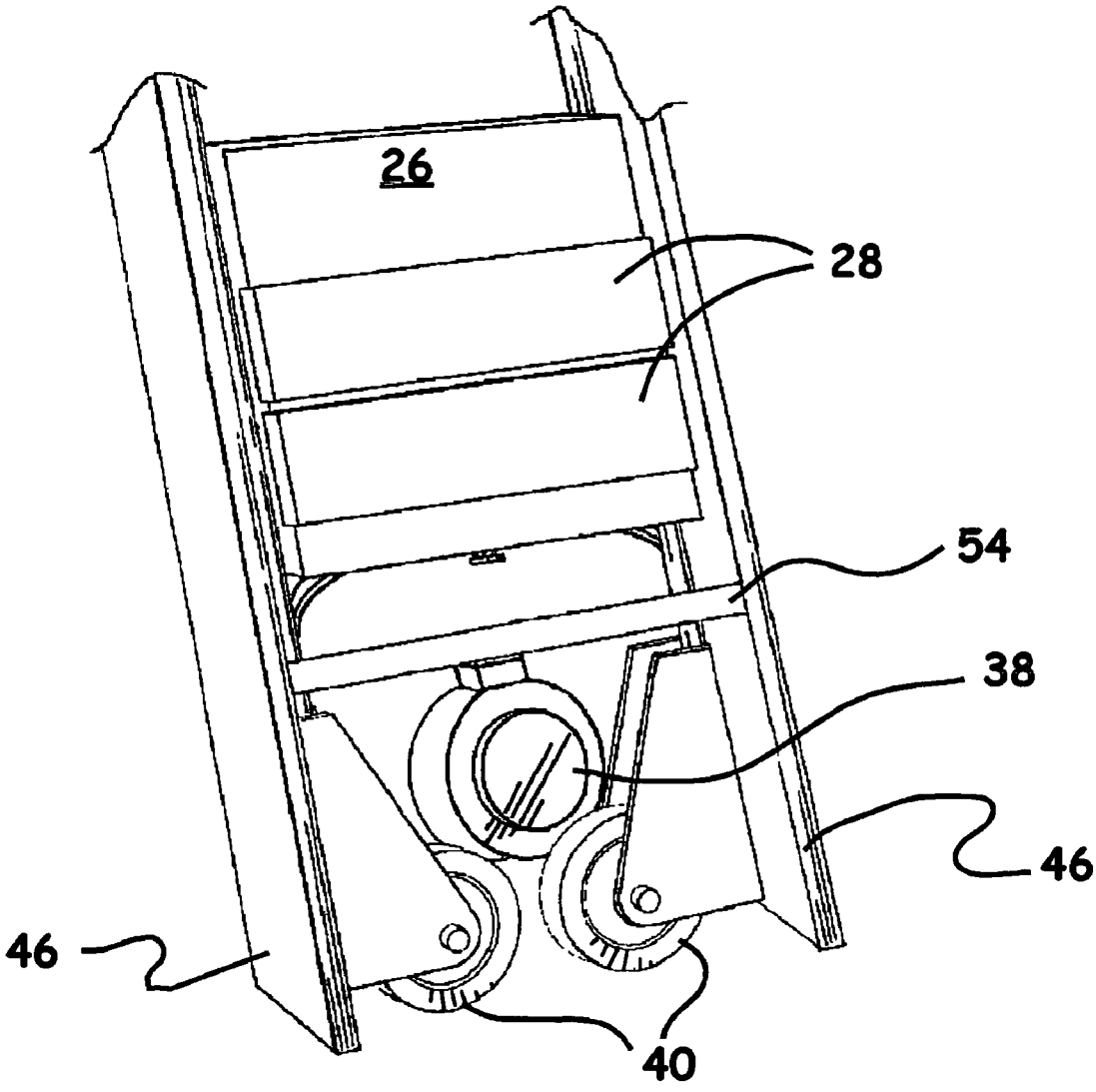
FIG. 8 is a perspective view showing closeup detail of the folding wheels or casters and a folded work platform, vise and storage drawer.
Figure 9:
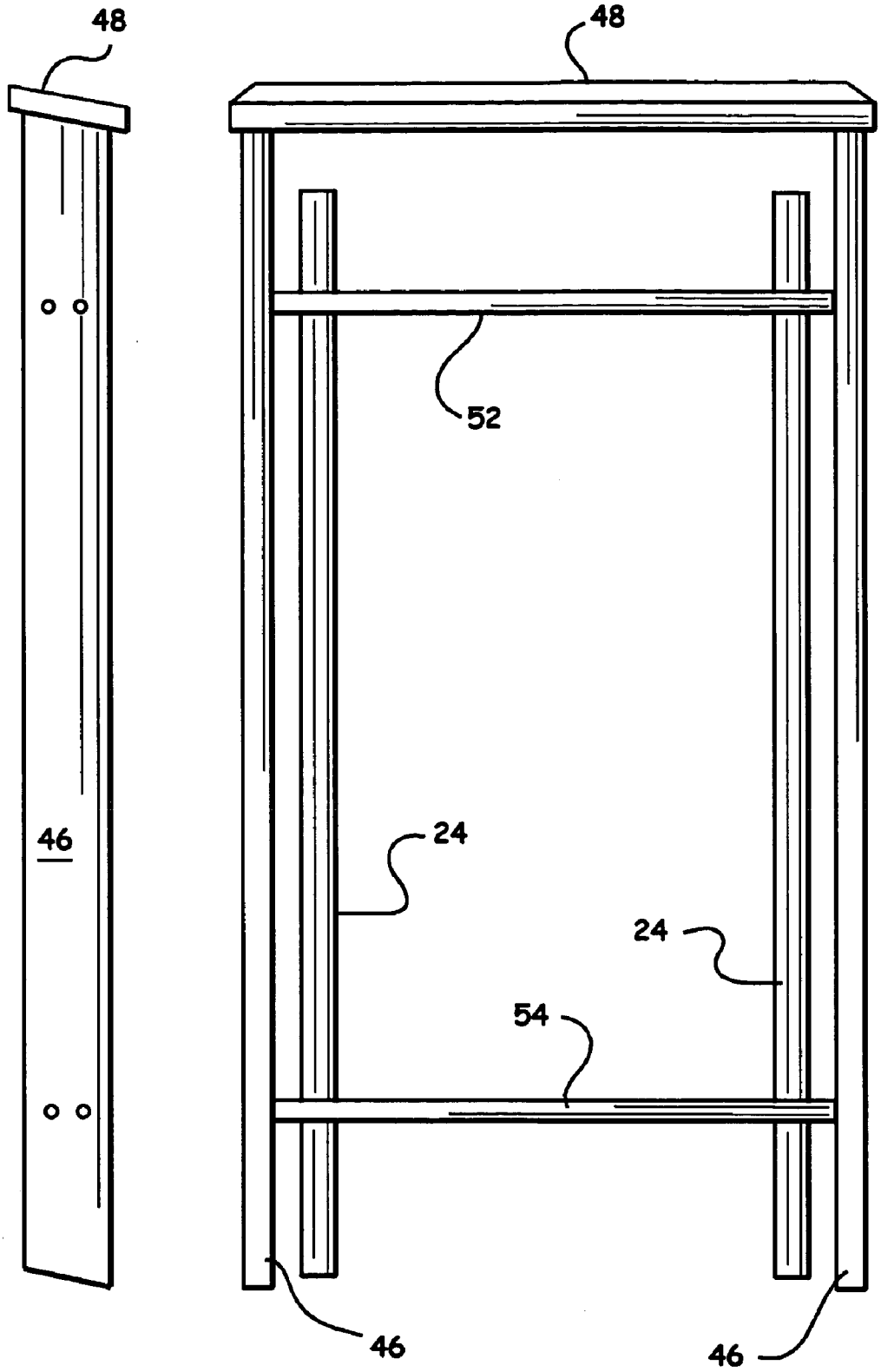
FIG. 9 shows rear and side elevations of the present invention in a folded configuration and particularly showing the equipment support members.
Figure 10:
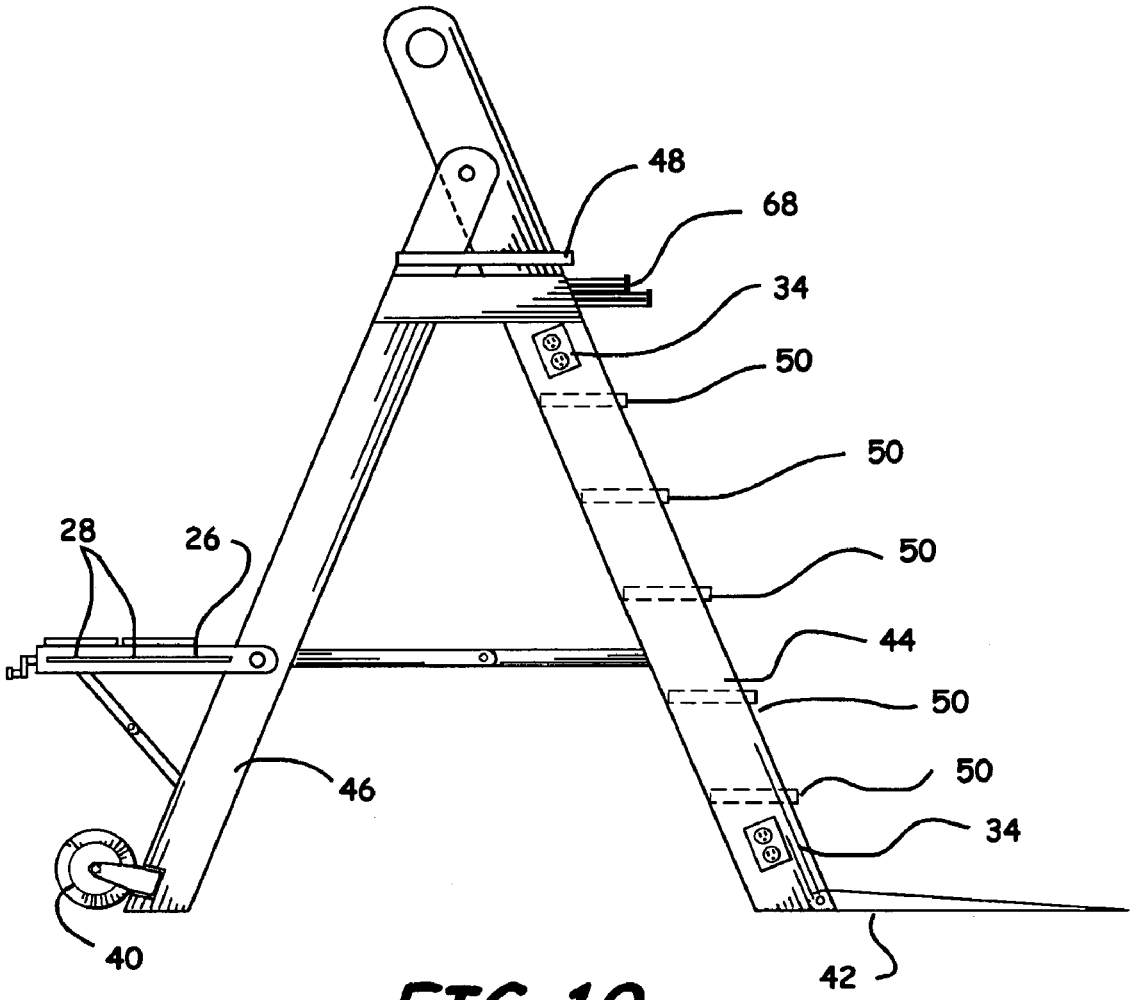
FIG. 10 shows a side elevation of the folding workbench deployed ready for use, showing its preferred isosceles triangle structure.
Figure 11:
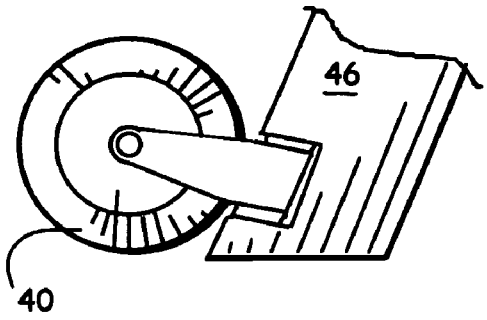
FIG. 11 is a side view in closeup detail of an alternate structure for a folding wheel in the present invention.

FIGS. 1–11 illustrate the present folding workbench and load dolly combination 20. The folding workbench 20 comprises a support frame 22, a pair of equipment support members 24, a work platform 26, a vise 28, a storage drawer 30, a light source 32, at least one electrical outlet 34, an electrical cord 36 in a storage reel 38, a plurality of wheels 40, and at least one handle 42. The support frame 22 has a first pair of legs 44 and a second pair of legs 46 hingedly connected to an upper frame member 48 and extending downwardly therefrom so as to open to define an A-frame shape, the first pair of legs including a plurality of rung members 50 connected between the first pair of legs to form a plurality of ladder steps, and the second pair of legs including at least two brace members connected spaced apart between the second pair of legs, an upper brace member 52 connected toward an upper end of the support frame and a lower brace member 54 connected toward a lower end of the support frame. A pair of equipment support members 24 includes a first equipment support member connected to the upper brace member 52 and to the lower brace member 54 and positioned on the support frame 22 generally parallel to a first leg of the second pair of legs 46, and a second equipment support member being connected to the upper brace member and to the lower brace member and positioned on the support frame generally parallel to a second leg of the second pair of legs. The work platform 26 is connected to the pair of equipment support members 24 so as to be repositionable upwardly or downwardly along the support members, the work platform being hingedly stowable against the pair of equipment support members or hingedly deployable therefrom. A vise 28 is positioned on an upper surface of the work platform 26. A storage drawer 30 is positioned along an underside of the work platform 26, and a light source 32 is adjustably connected to at least one of the equipment support members 24. At least one electrical outlet 34 is positioned on the support frame for providing power. A reel 38 contains an electrical cord 36 having one end connected to the at least one electrical outlet 34 and a second end having a plug connectable to a source of electricity, the electrical cord comprising a length which may be extended or retracted from the reel. A plurality of wheels 40 includes at least two wheels each foldably connected at a lower end of one of the equipment support members 24, and at least two wheels each foldably connected at an upper end of one of the equipment support members. At least a first handle 42 is foldably connected at a lower end of one of the equipment support members 24, and a second handle 56 is foldably connected at an upper end of one of the equipment support members. It is to be understood that any of the equipment features of the folding workbench may be connected to the equipment support members 24 or, alternatively, directly to a support frame 22 member.

In a preferred embodiment of the folding workbench 20, the A-frame shape defined by the support frame 22 approximately forms an isosceles triangle in side elevation. The support frame 22 comprises at least one hinge member 58 connecting a leg of the first pair of legs 44 with a leg of the second pair of legs 46 along a lateral extent of the support frame. Preferably, however, the support frame 22 comprises two hinge members 58, each hinge member connecting a leg of the first pair of legs 44 with a leg of the second pair of legs 46 along a lateral side of the support frame. The equipment support members 24 best comprise tubular members having a circular cross-section, although other structural configurations may also be used. For example, each the equipment support member 24 may be elongated and comprise a plurality of spaced-apart openings 60 arrayed along its length for therein receiving at least one retaining pin 62 engaged with equipment to be supported on the equipment support member. The folding workbench 20 may also include a work platform 26 which consists of the vise 28 serving as a work surface. The storage drawer 30 is slidably outwardly extensible from the work platform 26, and the light source 32 is best positioned on the support frame 22 above the work platform, and most preferably the light source is borne upon a hingedly repositionable arm 64. The at least one electrical outlet 34 comprises an electrical power strip having multiple outlets, preferably having protection against a power overload, which may be a fuse or a circuit breaker. The reel 38 may be manually actuated by a user, or may be spring-loaded so as to automatically retract the electrical cord.

In the present folding workbench 20 each foldably connected wheel 40 of the plurality of wheels deploys for rolling the folding workbench so that a radius of the wheel is generally perpendicular to an imaginary plane extending between outer surfaces of the equipment support members 24. Each foldably connected wheel 40 also stowes so that a radius of the wheel is generally parallel to an imaginary plane extending between outer surfaces of the equipment support members 24. Additionally, each foldably connected wheel 40 best comprises a lock member securing the wheel in either a deployed or a folded position.

Similarly, the at least first handle 42 and the at least second handle 56 each deploys so that a first imaginary plane lying approximately along a grip portion of the handle is generally non-perpendicular to a second imaginary plane extending between outer surfaces of the equipment support members 24. Conversely, the at least first handle 42 and the at least second handle 56 each stowes so that a first imaginary plane lying approximately along a grip portion of the handle is generally parallel to a second imaginary plane extending between outer surfaces of the equipment support members 24. Each foldably connected handle may further comprise a lock member securing the wheel in either a deployed or a folded position.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A folding workbench comprising:

a support frame having a first pair of legs and a second pair of legs hingedly connected to an upper frame member and extending downwardly therefrom so as to open to define an A-frame shape, said first pair of legs including a plurality of rung members connected between the first pair of legs to form a plurality of ladder steps, and said second pair of legs including at least two brace members connected spaced apart between said second pair of legs, an upper brace member connected toward an upper end of the support frame and a lower brace member connected toward a lower end of the support frame;

a pair of equipment support members, a first equipment support member being connected to said upper brace member and to said lower brace member and positioned on the support frame generally parallel to a first leg of said second pair of legs, and a second equipment support member being connected to said upper brace member and to said lower brace member and positioned on the support frame generally parallel to a second leg of said second pair of legs; and a plurality of wheels including at least two wheels each foldably connected at a lower end of one of said equipment support members, and at least two wheels each foldably connected at an upper end of one of said equipment support members.

2. The folding workbench of claim 1, wherein the A-frame shape defined by said support frame approximately forms an isosceles triangle in side elevation.

3. The folding workbench of claim 1, wherein said support frame comprises at least one hinge member connecting a leg of the first pair of legs with a leg of the second pair of legs along a lateral extent of said support frame.

4. The folding workbench of claim 1, wherein said support frame comprises two hinge members, each hinge member connecting a leg of the first pair of legs with a leg of the second pair of legs along a lateral side of said support frame.

5. The folding workbench of claim 1, wherein said equipment support members comprise tubular members having a circular cross-section.

6. The folding workbench of claim 1, wherein each said equipment support member is elongated and comprises a plurality of spaced-apart openings arrayed along its length for therein receiving at least one retaining pin engaged with equipment to be supported on said equipment support member.

7. The folding workbench of claim 1, further comprising a work platform connected to said pair of equipment support members so as to be repositionable upwardly or downwardly along said support members, said work platform being hingedly stowable against said pair of equipment support members or hingedly deployable therefrom.

8. The folding workbench of claim 7, further comprising a vise positioned on an upper surface of said work platform.

9. The folding workbench of claim 7, further comprising a storage drawer positioned along an underside of said work platform.

10. The folding workbench of claim 1, further comprising a light source adjustably connected to at least one of said equipment support members.

11. The folding workbench of claim 1, further comprising at least one electrical outlet positioned on said support frame for providing power.

12. The folding workbench of claim 1, further comprising a reel containing an electrical cord having one end connected to an electrical outlet and a second end having a plug connectable to a source of electricity, said electrical cord comprising a length which may be extended or retracted from said reel.

13. The folding workbench of claim 1, further comprising at least a first handle foldably connected at a lower end of one of said equipment support members, and a second handle foldably connected at an upper end of one of said equipment support members.

14. The folding workbench of claim 7, wherein said work platform comprises a vise.

15. The folding workbench of claim 9, wherein said storage drawer is slidably outwardly extensible from said work platform.

16. The folding workbench of claim 10, wherein said light source is positioned on said support frame above a work platform.

17. The folding workbench of claim 10, wherein said light source is borne upon a hingedly repositionable arm.

18. The folding workbench of claim 11, wherein said at least one electrical outlet comprises an electrical power strip having multiple outlets.

19. The folding workbench of claim 11, wherein said at least one electrical outlet comprises an electrical power strip having protection against a power overload.

20. The folding workbench of claim 11, wherein said at least one electrical outlet comprises an electrical power strip having a fuse.

21. The folding workbench of claim 11, wherein said at least one electrical outlet comprises an electrical power strip having a circuit breaker.

22. The folding workbench of claim 12, wherein said reel is manually actuated by a user.

23. The folding workbench of claim 12, wherein said reel is spring-loaded so as to automatically retract said electrical cord.

24. The folding workbench of claim 1, wherein each said foldably connected wheel of said plurality of wheels deploys for rolling the folding workbench so that a radius of the wheel is generally perpendicular to an imaginary plane extending between outer surfaces of said equipment support members.

25. The folding workbench of claim 1, wherein each said foldably connected wheel of said plurality of wheels stows so that a radius of the wheel is generally parallel to an imaginary plane extending between outer surfaces of said equipment support members.

26. The folding workbench of claim 1, wherein each said foldably connected wheel of said plurality of wheels further comprises a lock member securing the wheel in either a deployed or a folded position.

27. The folding workbench of claim 13, wherein said at least first handle and said at least second handle each deploys so that a first imaginary plane lying approximately along a grip portion of the handle is generally non-perpendicular to a second imaginary plane extending between outer surfaces of said equipment support members.

28. The folding workbench of claim 13, wherein said at least first handle and said at least second handle each stows so that a first imaginary plane lying approximately along a grip portion of the handle is generally parallel to a second imaginary plane extending between outer surfaces of said equipment support members.

29. The folding workbench of claim 13, wherein each said foldably connected handle further comprises a lock member securing the wheel in either a deployed or a folded position.

30. The folding workbench of claim 1, wherein each said foldably connected wheel of said plurality of wheels deploys for rolling the folding workbench so that a radius of the wheel is generally perpendicular to an imaginary plane extending between outer surfaces of said support frame.

31. The folding workbench of claim 1, wherein each said foldably connected wheel of said plurality of wheels stows so that a radius of the wheel is generally parallel to an imaginary plane extending between outer surfaces of said support frame.

32. The folding workbench of claim 13, wherein said at least first handle and said at least second handle each deploys so that a first imaginary plane lying approximately along a grip portion of the handle is generally non-perpendicular to a second imaginary plane extending between outer surfaces of said support frame.

33. The folding workbench of claim 13, wherein said at least first handle and said at least second handle each stows so that a first imaginary plane lying approximately along a grip portion of the handle is generally parallel to a second imaginary plane extending between outer surfaces of said support frame.

* * * * *